US011311158B1

(12) United States Patent
Coltrin et al.

(10) Patent No.: US 11,311,158 B1
(45) **Date of Patent: *Apr. 26, 2022**

(54) CENTRAL VACUUM CLEANING SYSTEM

(71) Applicant: Coltrin Central Vacuum Systems, Inc., Boise, ID (US)

(72) Inventors: Cory G. Coltrin, Boise, ID (US); Trevor D. Coltrin, Meridian, ID (US); Darrell V. Nieschwitz, Louisville, OH (US); Greg A. Calderone, Canton, OH (US); Shawn C. Metz, Louisville, OH (US)

(73) Assignee: Coltrin Central Vacuum Systems, Inc., Boise, ID (US)

( * ) Notice: Subject to any disclaimer, the term of this patent is extended or adjusted under 35 U.S.C. 154(b) by 487 days.

This patent is subject to a terminal disclaimer.

(21) Appl. No.: 16/383,094

(22) Filed: Apr. 12, 2019

Related U.S. Application Data

(62) Division of application No. 15/414,676, filed on Jan. 25, 2017, now Pat. No. 10,405,713.

(60) Provisional application No. 62/287,620, filed on Jan. 27, 2016.

(51) Int. Cl.

| | |
|---|---|
| ***A47L 9/04*** | (2006.01) |
| ***A47L 5/38*** | (2006.01) |
| ***A47L 9/24*** | (2006.01) |

(52) U.S. Cl.
CPC ..... *A47L 5/38* (2013.01); *A47L 9/244* (2013.01)

(58) Field of Classification Search
CPC ..... A47L 5/38; A47L 9/244
See application file for complete search history.

(56) References Cited

U.S. PATENT DOCUMENTS

| | | | | |
|---|---|---|---|---|
| 2,953,806 | A | 9/1960 | Walker | |
| 3,027,587 | A | 4/1962 | Bierstock | |
| 3,027,588 | A | 4/1962 | Bierstock | |
| 3,520,725 | A | 7/1970 | Hamrick | |
| 3,593,363 | A | 7/1971 | Hamrick | |
| 3,676,986 | A | 7/1972 | Reiling | |
| 4,050,113 | A | 9/1977 | Wright et al. | |
| 4,163,593 | A * | 8/1979 | Kosik | H01R 13/005 439/194 |
| 4,715,086 | A * | 12/1987 | Johanson | A47L 9/2889 15/339 |
| 5,387,117 | A * | 2/1995 | Moyher, Jr | A47L 9/246 15/314 |
| 5,504,967 | A | 4/1996 | Graham | |

(Continued)

*Primary Examiner* — Michael D Jennings
(74) *Attorney, Agent, or Firm* — Sand, Sebolt & Wernow Co., LPA

(57) ABSTRACT

A central vacuum cleaning system having a floor level debris pickup valve preferably mounted in the bottom of a cabinet and connected to a tubular conduit of a vacuum producing unit by a connection assembly. The connection assembly includes a flexible and expandable hose having a pair of end connectors. Each end connector preferably is a bayonet connector. The hose is connected at one end to the rigid tubular conduit of the central vacuum system and the other end connector is pulled through an opening formed in the cabinet by expanding the hose. The expandable hose enables the pickup valve to be attached easily to the other end of the hose, after which the hose is retracted back into a restricted space below the cabinet bottom wall and the pickup valve then attached to the cabinet.

21 Claims, 4 Drawing Sheets

(56) References Cited

U.S. PATENT DOCUMENTS

| | | | | |
|---|---|---|---|---|
| 5,933,914 | A | 8/1999 | Beane | |
| 6,108,858 | A | 8/2000 | Smith | |
| 6,292,977 | B1 | 9/2001 | Mantyla et al. | |
| 7,010,829 | B2 | 3/2006 | Harman et al. | |
| 7,306,012 | B2 | 12/2007 | Stockton et al. | |
| 7,549,448 | B2 * | 6/2009 | Ragner | A47L 9/24 138/119 |
| 7,624,472 | B2 | 12/2009 | Ambrose | |
| 8,001,650 | B2 | 8/2011 | Trotter | |
| 8,479,353 | B2 | 7/2013 | Drivstuen et al. | |
| 8,819,891 | B2 | 9/2014 | Parkinson | |
| 9,610,586 | B2 | 4/2017 | Simplavate | |
| 9,726,394 | B2 | 8/2017 | Buchanan | |
| 10,405,713 | B1 * | 9/2019 | Coltrin | A47L 9/244 |
| 2006/0174440 | A1 * | 8/2006 | Genoa | A47L 9/242 15/410 |
| 2012/0255758 | A1 * | 10/2012 | Lee | A47L 5/38 174/47 |
| 2012/0304414 | A1 | 12/2012 | Harman | |
| 2014/0259509 | A1 | 9/2014 | Harman | |
| 2017/0347849 | A1 * | 12/2017 | Majer | A47L 9/242 |

* cited by examiner

FIG-2
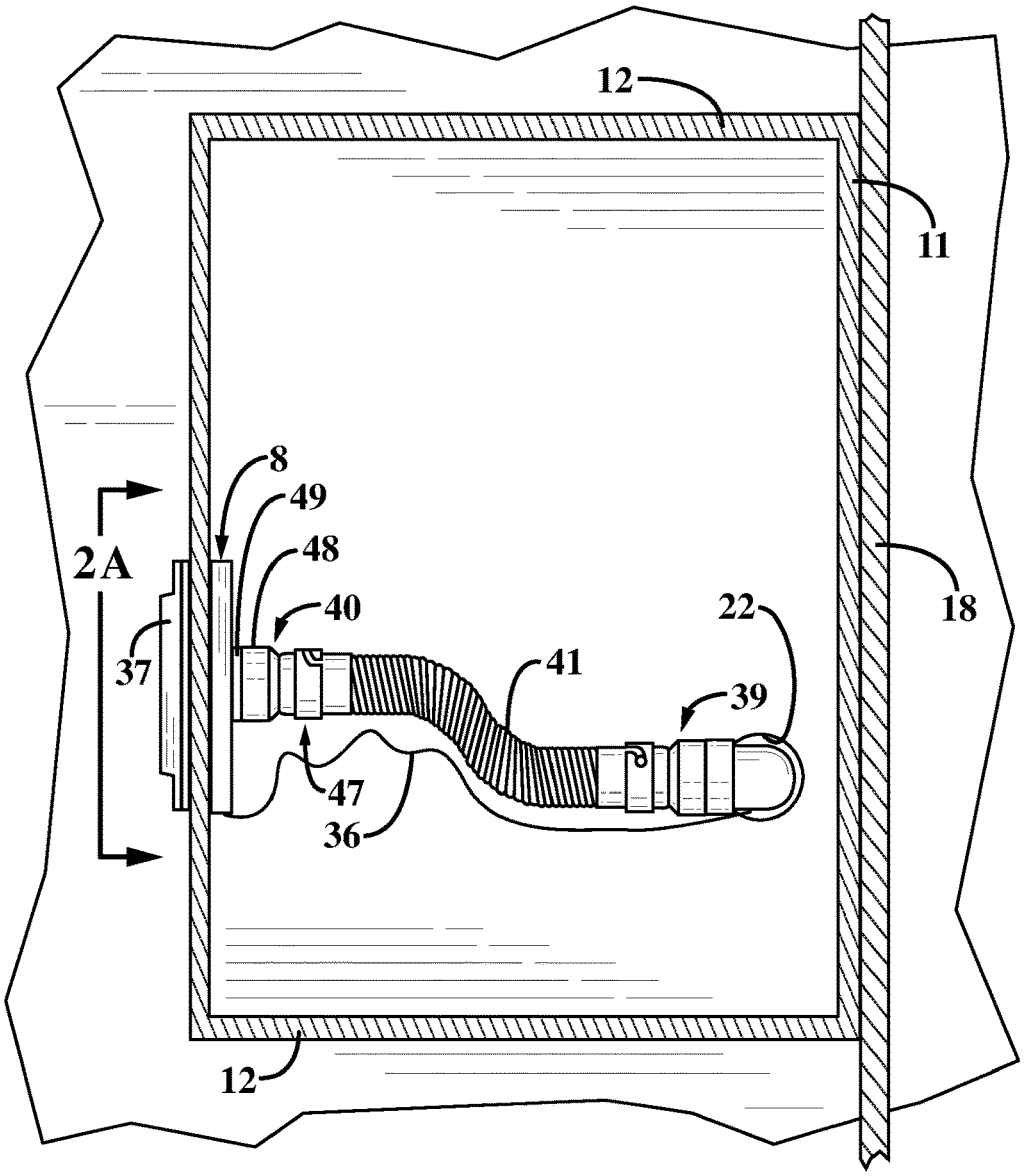
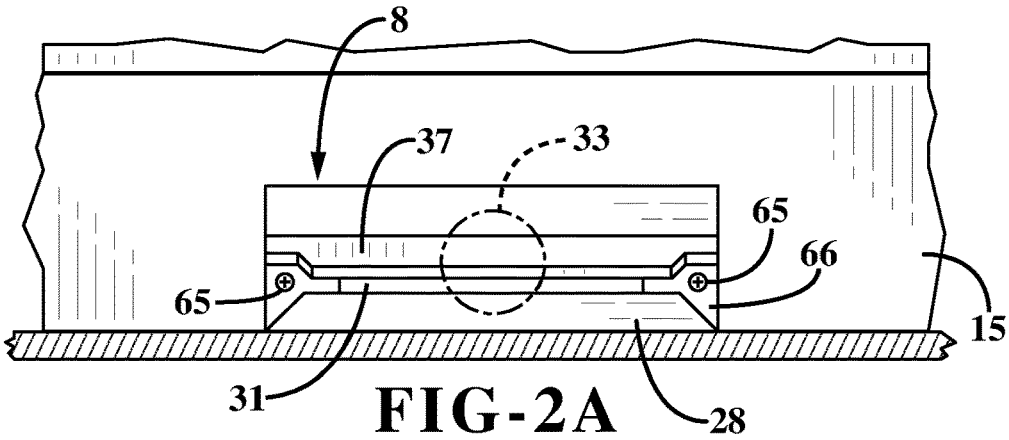
FIG-2A

CENTRAL VACUUM CLEANING SYSTEM

CROSS-REFERENCE TO RELATED APPLICATION

This application is a divisional application which claims priority from U.S. patent application Ser. No. 15/414,676, filed Jan. 25, 2017, which claims priority from a U.S. Provisional Patent Application Ser. No. 62/287,620 filed Jan. 27, 2016, the disclosures of which are incorporated herein by reference.

BACKGROUND OF THE INVENTION

Technical Field

The invention relates to a central vacuum cleaning system, and in particular, to a debris pickup inlet nozzle located in the bottom of a cabinet for transferring debris swept along the floor and into the nozzle for subsequent transfer through the conduits of a central vacuum cleaning system to a remote waste receptacle. Even more particularly, the invention relates to such a vacuum cleaning system in which the debris pickup nozzle is connected to a conduit of the central vacuum cleaning system by a flexible hose and a pair of manually actuated end connectors enabling ease of installation and subsequent repair of the components heretofore inaccessible under the bottom shelf of the cabinet.

Background Information

Central vacuum cleaning systems have become increasingly common in new home constructions, as well as in commercial buildings, recreational vehicles, workshops, etc. wherein a plurality of inlet nozzles are located at various locations in the walls of the building for subsequent connection to a hose of a debris pickup wand for transferring the picked up dirt, debris, etc. through the inlet nozzle and attached tubular conduits to a central vacuum waste receptacle usually located in the basement of the building or other accessible remote area. Most of these inlet valves are adapted to receive the end of a hose which is moved between various rooms of the building, which inlet valves may have an electric switch, which when opened and closed will automatically start and stop the central vacuum producing unit.

More recently, another type of inlet valve is being utilized in a central vacuum cleaning system. The valve is located in the floor, kick plate, side wall, or baseboard area of a cabinet or room and has an elongated inlet nozzle at the floor level whereupon debris and dirt is swept by a broom into the inlet nozzle for subsequent transport by the vacuum produced therein to the remotely located waste receptacles. These debris pickup nozzles usually have a closure plate which can be easily opened and closed by the foot of the user and which automatically controls the vacuum producing unit requiring the user only to sweep the debris towards the nozzle where it is readily sucked through the nozzle and into the tubular conduit of the central vacuum cleaning system.

Many of these pickup nozzles are located in the kick plate or sidewall of a cabinet such as found in a work area, kitchen, shop, etc. The pickup nozzle is connected to the main vacuum conduit by rigid tubing which is located in a space formed below the bottom shelf of the cabinet, which then passes through an opening in the rear or bottom wall of the cabinet and through an adjacent wall for subsequent connection to the tubular conduit of the vacuum cleaning system. Due to the confined space beneath the bottom shelf of the cabinet and difficulty in securing access thereto, it is difficult and time consuming to easily connect the inlet nozzle of the floor level pickup valve to the tubular conduit of the vacuum cleaning system, and even more difficult to make repairs to the connecting conduit located in the concealed spaced beneath the bottom shelf of the cabinet or to the inlet nozzle which must be disconnected from the conduit beneath the bottom shelf for repair.

Thus, the need exists for a central vacuum cleaning system and method of installation and repair, and in particular, to a debris pickup device mounted at floor level usually beneath a bottom shelf of a cabinet or other structure, which enables the dirt and the debris to be swept directly into the nozzle, which can be easily installed and subsequently repaired even though many of the components are in an area having limited accessibility.

SUMMARY

In one aspect, the invention may provide a central vacuum cleaning system comprising: a structure formed with an aperture; a debris pickup device removably mounted in the aperture and secured to said structure; said pickup device having an inlet nozzle and a rear outlet opening, said inlet nozzle being adjacent the level of a floor adjacent said structure; a vacuum source located remotely from the structure and pneumatically connected to the rear outlet opening of the debris pickup device; a tubular conduit extending from the vacuum source to adjacent the pickup device; a connection assembly adapted to be located in a space not easily accessible in said structure, said connector assembly including a length of flexible hose extending between and connected to first and second end connectors, said first end connector being attachable to the rear outlet opening of the pickup device and the second end connector being attachable to the tubular conduit of the vacuum source; and each of said end connectors of the connection assembly being a manually actuated connection.

In another aspect, the invention may provide a connection assembly for pneumatically connecting an end of a rigid conduit of a vacuum cleaning system to a debris pickup device comprising: a length of an expandable hose terminating in a pair of open ends and a pair of end connectors mounted on said open ends of the expandable hose, each of said end connectors having a cylindrical male cuff connected to a respective open end of the hose and a female receptor, one of said female receptors being adapted to be connected to the rigid conduit and the other of said female receptors being adapted to be connected to the debris pickup device; and a lug extending outwardly from the male cuff of each end connector releasably secured with a slot formed in each of the female receptors for releasably connecting said male cuffs within said female receptor.

In another aspect, the invention may provide a method of installing a floor level debris pickup device of a central vacuum cleaning system in a first opening formed in a structure comprising the steps of: providing a connection assembly including a section of a flexible expandable hose and first and second end connectors mounted on respective open ends of the hose; extending a rigid section of a tubular conduit pneumatically connected to a vacuum producing unit through a second opening formed in the structure; connecting the first end connector of the connection assembly to an end of the tubular conduit; grasping and pulling outwardly on the hose expanding the hose beyond the first opening of the structure for ease of accessibility; connecting the second end connector of the connector assembly to the pickup device; moving the pickup device into said first opening formed in the structure by collapsing the expanded hose into an area between said two openings; and securing the pickup device in said first opening of said structure.

BRIEF DESCRIPTION OF THE SEVERAL VIEWS OF THE DRAWINGS

A sample embodiment of the invention is set forth in the following description, is shown in the drawings and is particularly and distinctly pointed out and set forth in the appended claims.

FIG. 2 is a sectional view taken on line 2-2, FIG. 1.

FIG. 2A is an enlarged fragmentary view looking in the direction of Arrows 2A, FIG. 2.

Similar numbers refer to similar parts throughout the drawings.

DETAILED DESCRIPTION

Figure 1:
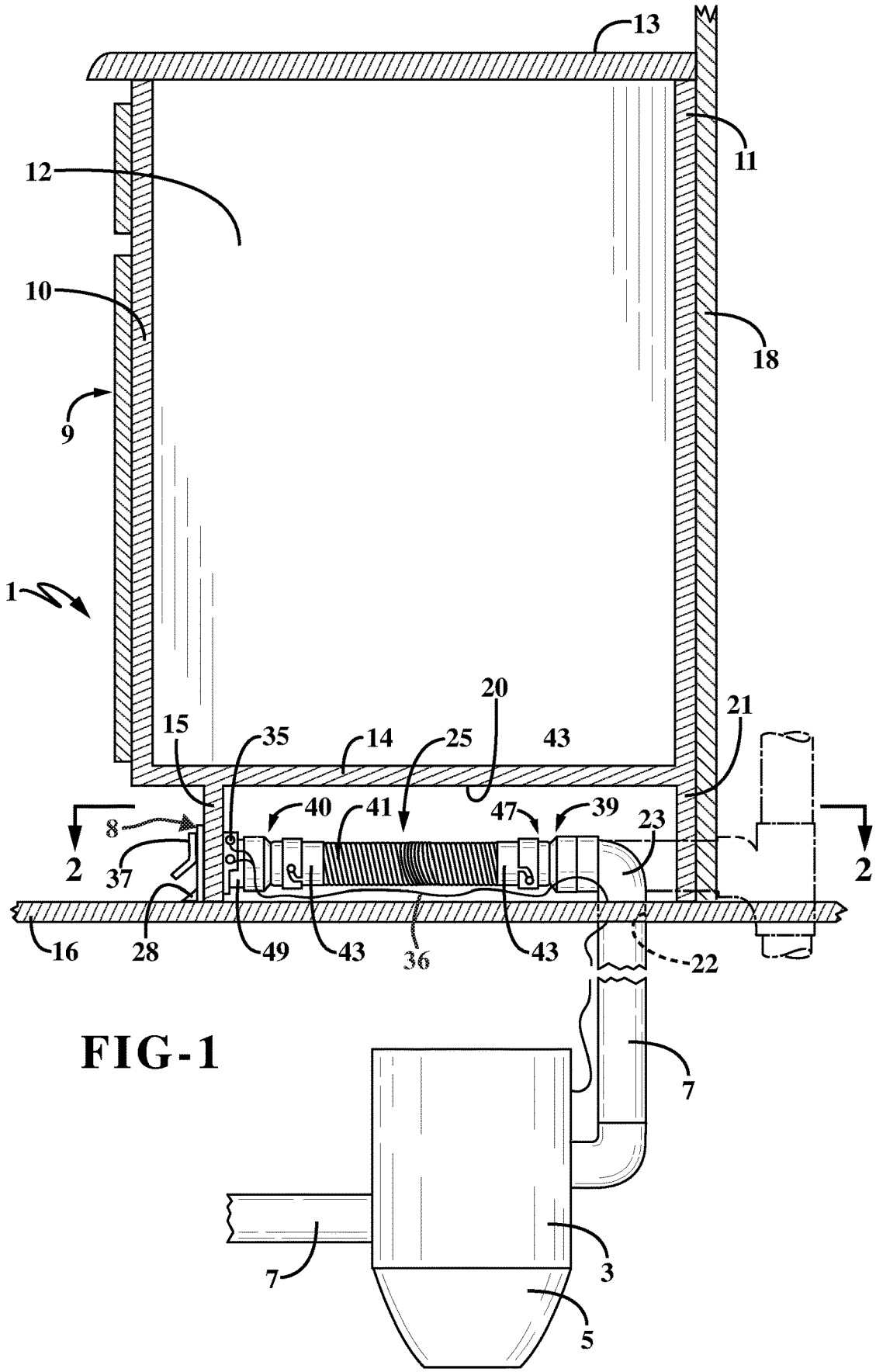
FIG. 1 is a diagrammatic side view with portions in section showing the vacuum cleaning system of the present invention installed beneath the bottom shelf of a cabinet with the debris pickup device mounted in the cabinet kick plate.

The improved vacuum cleaning system of the present invention is indicated generally at 1, and is shown in particular in FIGS. 1 and 2. The vacuum cleaning system will include a main vacuum producing unit 3 which is usually located in the basement or other remote area of a building and has a waste receptacle 5 in which the debris is collected for subsequent removal and disposal. Vacuum unit 3 is connected to various inlet openings (not shown) located throughout the building by various lengths of rigid conduits 7 usually formed of rigid plastic material. The vacuum system of the present invention, and in particular a debris pickup device indicated generally at 8, will usually be associated with a cabinet 9, although it could be connected directly to a baseboard of a wall or other rigid structure in a building or vehicle without departing from the concept of the present invention. Cabinet 9 is of the usual construction of the type installed in a kitchen, laundry room, workshop, garage etc. The cabinet includes a plurality of walls, including a front wall 10, back wall 11, spaced sidewalls 12, top wall 13, and a bottom wall 14. Cabinet 9 usually will include a front wall 15 commonly referred to as a kick plate or toe plate which extends from bottom wall 14 to subsequently rest upon a floor 16 or other supporting structure.

Cabinet 9 usually is secured by various fasteners to a rear or adjacent wall 18 of the structure in which the cabinet is located. The configuration of cabinet 9 can vary appreciably without affecting the concept of the invention. However, as in most cabinets, especially of the type having a toe plate 15, an interior space 20 is formed between bottom wall 14, toe plate 15, and a bottom portion 21 of rear wall 11. When mounting pickup device 8 in cabinet 9, a section of tubular conduit 7 will extend through a hole 22 formed in floor 16 and is usually connected by a 90 degree elbow 23 to one end of a connection assembly indicated generally at 25. Connection assembly 25 which is described in further detail below connects tubular conduit 7, and in particular elbow 23, to debris pickup device 8.

In accordance with one of the features of the present invention, pickup device 8 is a floor level inlet-type valve which has an elongated bottom lower lip 28 which is in contact with floor 16. This enables dirt and other debris on the floor to be swept by a broom directly along lip 28 and into an elongated inlet nozzle 31 (FIG. 2A) where it is drawn through pickup device 8 and out through a circular rear opening 33 and through connection assembly 25 and conduit 7 into waste receptacle 5 by the vacuum produced by unit 3. Debris pickup device 8 can have various configurations which are well-known in the art, such as shown in U.S. Pat. Nos. 5,504,967; 6,108,858; 6,292,977; and 8,819,891, the contents of which are incorporated herein by reference. Thus, the particular type and configuration of pickup device 8 can vary without affecting the concept of the present invention, and can be incorporated into the system of the present invention without difficulty.

Figure 7:
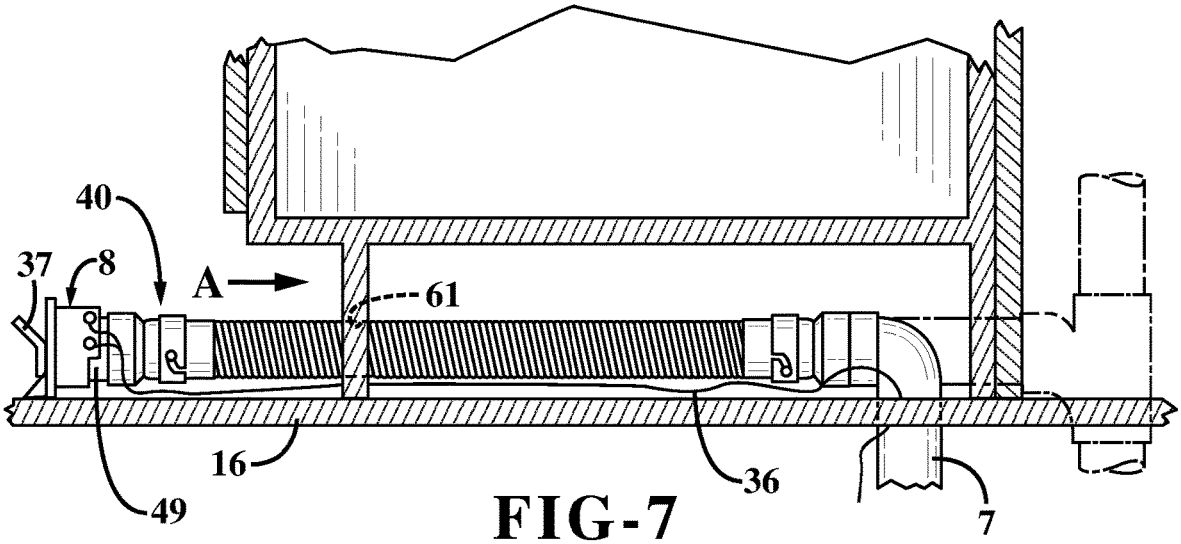

Pickup device 8 preferably will have an electrical switch (not shown) having outlet terminals 35 connected by wires 36 to unit 3 so that a vacuum producing motor within unit 3 is started and stopped by the actuation of a door 37 which usually is hingedly mounted on the front of pickup device 8 for movement between an open position as shown in FIG. 1 and a closed position as shown in FIG. 7 with respect to inlet nozzle 31.

Figure 5:
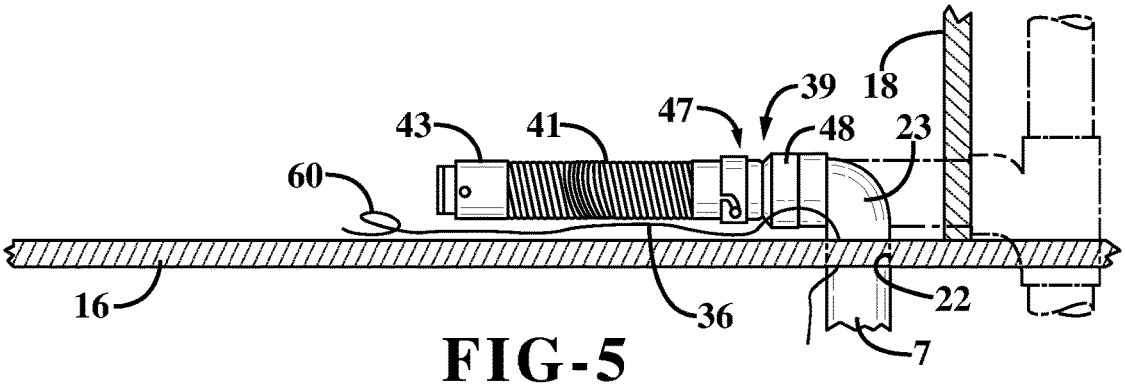
FIGS. 5-7 are diagrammatic views showing the method of installing the debris pickup device within a cabinet.

In further accordance with one of the main features of the present invention, connection assembly 25 includes a pair of manually actuated end connectors indicated generally at 39 and 40, and an intervening section of a flexible hose 41. Hose 41 is of a well-known construction used in vacuum cleaning systems consisting of a conventional flexible plastic tubing preferably having a spiral rib design and containing a helical coil spring 46 fitted tightly within the flexible tubular plastic sleeve making the hose extensible and contractible. Some examples of such a hose are shown in U.S. Pat. Nos. 2,953,806; 3,520,725; 4,050,113; and 8,001,650, the contents of which are incorporated herein by reference. In a preferred embodiment, hose 41 will have an expansion factor of approximately 4.5 to 1. Thus, when in an extended position, it will have a length of approximately 4½ times it's retracted or at rest position as shown in FIG. 5.

Figure 3:
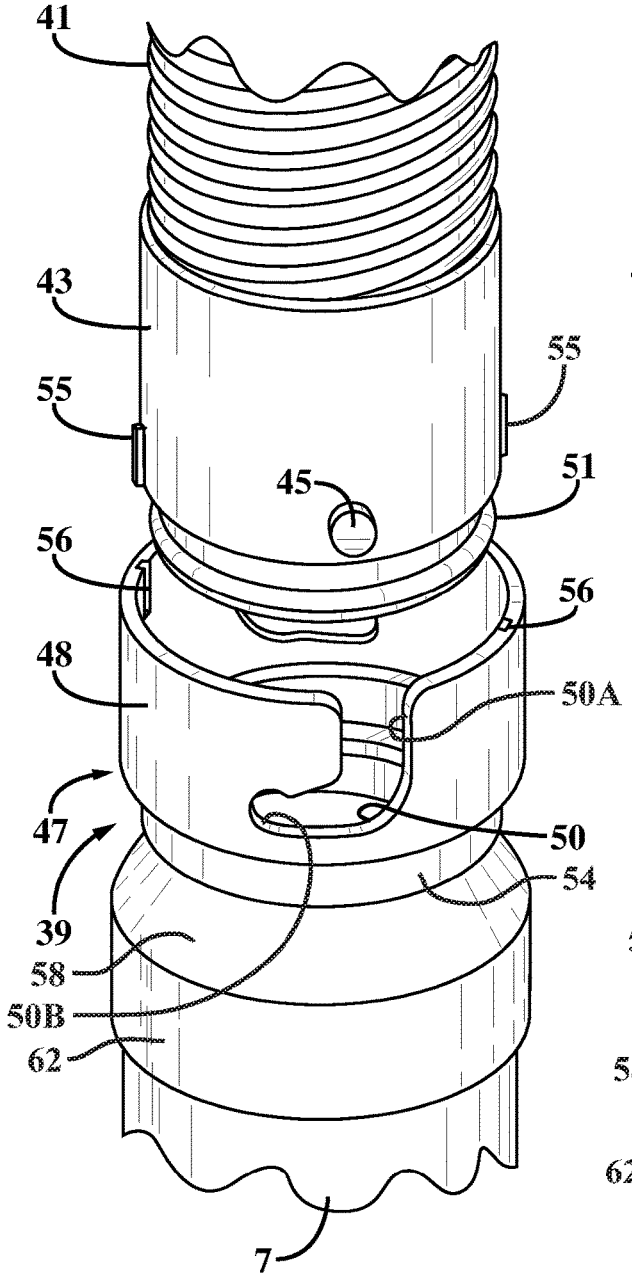
FIG. 3 is a fragmentary perspective view showing one of the hose end connectors in a disassembled position.
Figure 4:
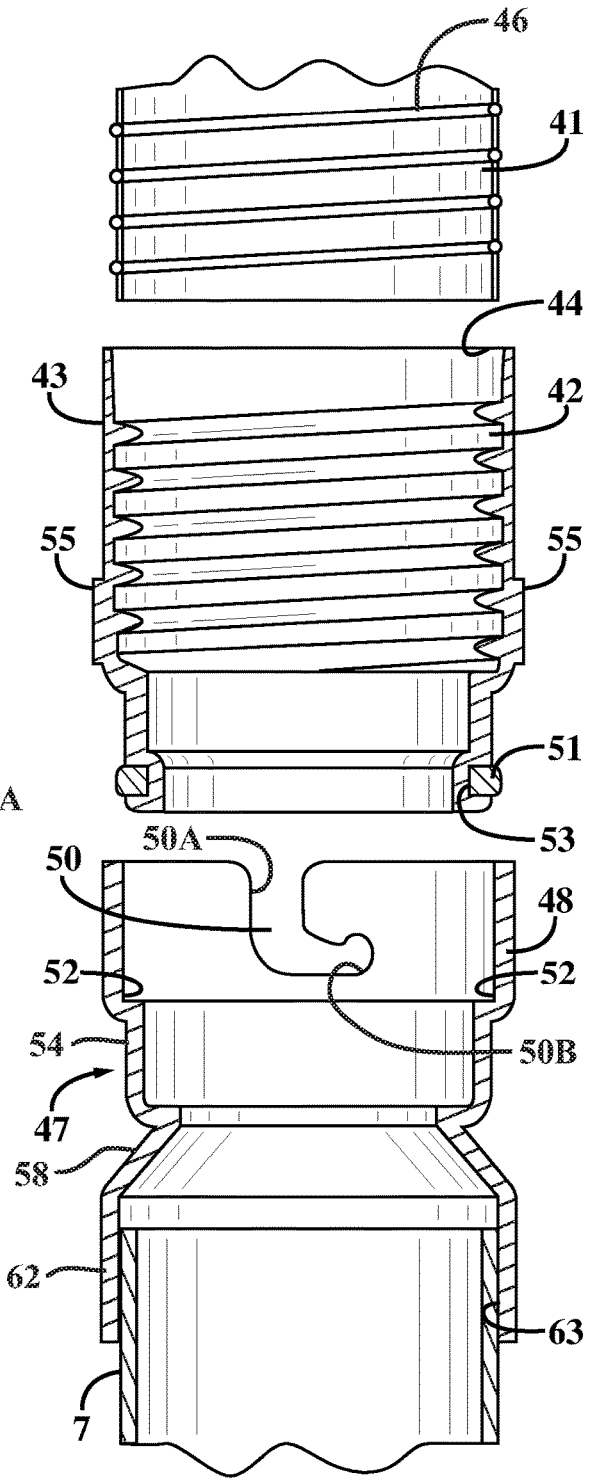
FIG. 4 is a sectional view of the hose end connector shown in FIG. 3.

FIGS. 3 and 4 show in detail end connector 39 which connects flexible hose 41 to rigid conduit 7 or directly to elbow 23. End connector 40 is similar to connector 39 and thus it is not described in further detail. End connectors 39 and 40 preferably are a bayonet-type of connector consisting of a cylindrical male cuff 43 which is connected to hose 41 and a female receptor indicated generally at 47 which is connected directly to conduit 7, elbow 23 or to an annular collar 49 attached to pickup valve 8 at rear opening 33 thereof as shown in FIGS. 1 and 2.

Cuff 43 includes one or more radially outwardly extending lugs or buttons 45 which are axially received into and then rotated into an axial section 50A and a radial section 50B of L-shaped slots 50 formed in a cylindrical collar 48 of female receptor 47 to lock male cuff 43 and female receptor 47 together. An O-ring 51 is mounted in a groove 53 formed adjacent the open end of male cuff 43 and is compressed against an annular shoulder 52 formed between cylindrical collar 48 and a reduced diameter cylindrical section 54 of female receptor 47 to provide an air seal for the vacuum contained within conduit 7 and hose 41, as well as providing an axial force between lock members 43 and 47 of the end connector to secure buttons 45 in the radial end section of L-shaped slots 50. Section 54 terminates in an outwardly flared section 58, which terminates in a cylindrical end section 62 forming open end 63 which receives an end of rigid conduit 7 (FIG. 4).

To further increase the ease of installation of end connectors 39 and 40 of connection assembly 25 between debris pickup device 8 and elbow 23 or conduit 7 as discussed further below, one or more flexible ridges 55 are formed on and extend axially along male cuff 43. Ridges 55 will snap into complementary-shaped axially extending grooves 56 formed along the inside surface of cylindrical collar 48 of female receptor 47. As male cuff 43 and female receptor 47 are rotated with respect to each other, ridges 55 will snap into grooves 56 when buttons 45 have reached the ends of radial sections 50B of L-shaped slots 50 providing an audible sound or indication to the installer that the proper connection has been made between the two end connector components.

End connector 40 includes the same cylindrical male cuff 43 and female receptacle 47 as connector 39 discussed above with male cuff 43 being connected to the end of hose 41 by an adhesive or other connection with female receptor 47 being connected to the outwardly projecting cylindrical collar 49 which defines rear opening 33 at the outlet end of debris pickup device 8. Other types of floor level pickup devices will have a connection port or collar that comes out of the top of the device instead of the back as shown by cylindrical collar 49. The present invention, including connection assembly 25, is easily attached to and used with these upwardly extending connection ports without difficulty.

Figure 6:
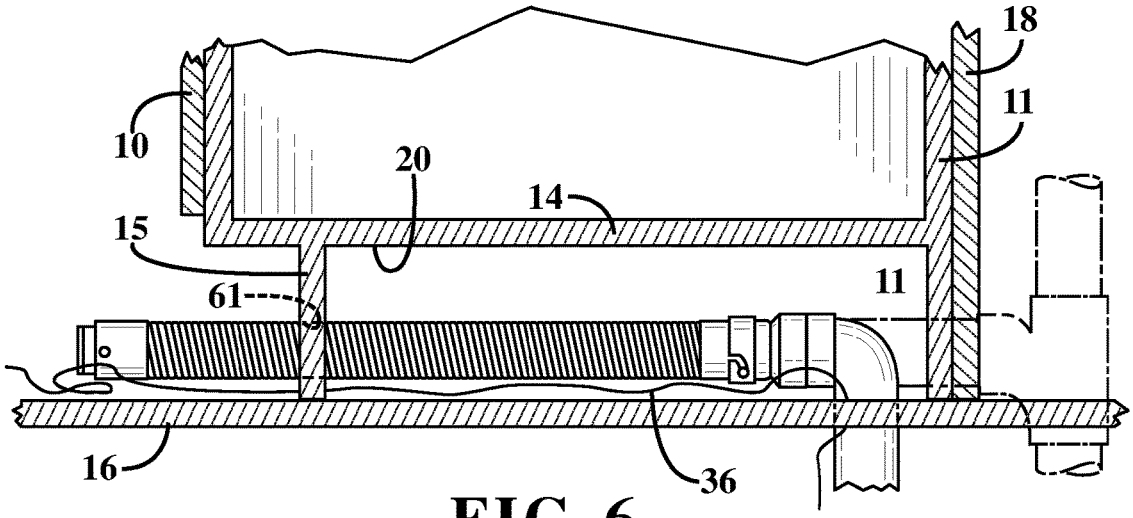

The method of installing the improved vacuum system of the present invention is shown diagrammatically in FIGS. 5-7. As shown in FIG. 5, hole 22 will be cut through floor 16 prior to the installation of cabinet 9 whereupon conduit 7 will extend therethrough and be connected to elbow 23. Annular collar 48 of female receptacle 47 then is connected to elbow 23 or directly to conduit 7 preferably by an adhesive. Male cuff 43 is attached to an end of hose 41 as discussed above and then inserted axially into female receptor 47 and rotated until lugs 45 reach the end of L-shaped slots 50 and ridges 55 snap into axial grooves 56 to secure end connector 39 together in a substantially air-tight joint. Hose 41 preferably will be in its at rest contracted position and together with end connector 39 will be placed on and lie along floor 16 as shown in FIG. 5. A male cuff 43 of end connector 40 is secured to the end of hose 41 usually by a threaded engagement as discussed above. Wires 36 will also be extended through hole 22 and formed into a coil 60 and placed adjacent the attached male cuff 43 at the end of hose 41.

As shown in FIG. 6, cabinet 9 is then placed in its desired position in the structure and attached to an adjacent wall 18. Connection assembly 25, and in particular hose 41 and cuff 43 attached to the extended end of hose 41 will be located within interior space 20 beneath bottom wall 14. The installer then easily reaches through an opening 61 previously cut into kick plate 15 and grasps the previously installed male cuff 43 easily pulling a portion of attached hose 41 through opening 61 exteriorly of kick plate 15. The expansion feature of hose 41 easily enables male cuff 43 to be pulled sufficiently beyond the edge of the cabinet where the installer can then easily connect male cuff 43 to a female receptor 47 which had been previously attached to outwardly projecting cylindrical collar 49 at rear opening 33 of pickup device 8 by the axial rotational snap-fit engagement between the two members discussed above. Cylindrical collar 49 of pickup device 8 is easily inserted into the cylindrical open end 63 of receptor 47 and secured thereto such as with an adhesive. After securing end connection 40, the installer places pickup device 8 within the complementary-shaped aperture or opening 61 by movement in the direction of Arrow A, which is easily performed since hose 41 will easily retract to a necessary length between end connectors 39 and 40. Pickup device 8 is then easily secured to kick plate 15 by a pair of screws 65 (FIG. 2A) or other type fasteners which extend through a pair of holes formed in a base plate 66 of pickup device 8 and into kick plate 15.

The same installation procedure would be followed whether tubular conduit 7 extends upwardly through floor 16 or enters through a hole formed in section 21 of rear wall 11 of cabinet 9 as shown by the dot-dash lines in FIGS. 5-7, or extend downwardly along wall 17 or other portions of the surrounding structure.

Another advantage of the improved vacuum cleaning system of the present invention is that repairs can be made easily to pickup device 8 and connection assembly 25 should it become necessary, which occasionally will occur, especially after continued use of the pickup device and the opening and closing of door 37, and the actuation of the electrical switch or any possible damage to hose 41. To perform such maintenance, the repairman merely removes screws 65 and pulls outwardly on pickup device 8, which will move device 8 outwardly through opening 61 followed by attached end connector 40 and a section of flexible hose 41 to a position such as shown in FIG. 7, whereupon any repair or replacement can be made easily to the exposed connector 40 and/or pickup device 8. After making such a repair or replacement, the pickup device is then placed back into position within opening 61 and secured by screw 65 with hose 41 retracting toward an at rest position as shown in FIG. 1.

Another problem that is occasionally encountered with floor level debris pickup devices is that a clog can occur between the device and elbow 23. Such clogs are easily removed by simply removing screws 65 and pulling outwardly on pickup device 8 which stretches connection assembly 25 and hose 41 outwardly, after which by turning the vacuum system ON it will in most cases release the clog from this area.

It is readily understood that pickup device 8 could be located in a sidewall of cabinet 9, as well as located in a baseboard of a room or other structure without affecting the concept of the invention. Regardless of its mounting location, the flexible hose, together with the two end connectors preferably of the bayonet-type, will enable the installer and subsequent repair personnel to easily remove the attached pickup device from its mounting and have ready access to hose 41 and end connectors 39 and 40 by the use of expandable hose 41 which ultimately pneumatically connects to the vacuum producing unit and waste disposal receptacle. Furthermore, end connectors 39 and 40 could be other types of connectors than the bayonet-type, although the bayonet-type connectors enable the installer or repair personnel to quickly and positively connect the two ends of the flexible hose to the rigid conduit of the central vacuum cleaning system and to the outlet collar of the debris pickup device without visually seeing the connection as would be the case when the connection is made beneath the bottom wall of the cabinet at the end of the rigid tubular conduit projecting through the floor of the structure. The clicking sound of flexible ridges 55 into grooves 56 indicates to the workman that the proper air-tight connection has been accomplished.

The use of flexible expandable hose 41 avoids the necessity of providing a straight alignment between the incoming end of conduit 7 and the outlet end of the debris pickup device and the avoidance of using multiple bends and elbows when a rigid conduit connection is made therebetween.

Furthermore, the connection assembly 25 is adaptable for use with a variety of floor-level debris pickup devices since most of these devices terminate in a cylindrical collar heretofore used to connect directly to a rigid tubular section of the central vacuum cleaning system.

Furthermore, connection assembly 25 is adaptable for use with central vacuum systems in a variety of structures such as a structure having a basement or crawl space with a floor 16 as shown in the drawings or even in a structure supported on a slab. In these structures, the rigid tubing will be coming down the inside of the wall and through the back of the cabinet without penetrating the floor, all within the concept of the present invention. Assembly 25 also can be used to connect other debris pickup devices that may or may not be located at the floor level such as in cabinets where space is tight and limited. Mobile homes and various campers can easily make use of such an installation where space is at a premium.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration set out herein are an example and the invention is not limited to the exact details shown or described.

The invention claimed is:

1. A connection assembly for pneumatically connecting an end of a rigid conduit of a vacuum cleaning system to a debris pickup device comprising:

a length of an expandable hose terminating in a pair of open ends and a pair of end connectors mounted on said open ends of the expandable hose, each of said end connectors having a cylindrical male cuff connected to a respective open end of the hose and a female receptor, one of said female receptors being adapted to be connected to the rigid conduit and the other of said female receptors being adapted to be connected to the debris pickup device; and a lug extending outwardly from the male cuff of each end connector releasably secured with a slot formed in each of the female receptors for releasably connecting said male cuffs within said female receptor.

2. The connector assembly defined in claim 1 wherein the hose has an expansion factor of approximately 4.5 to 1.

3. The central vacuum cleaning system defined in claim 1 wherein at least one flexible ridge is formed on and extends axially along each of the male cuffs; and in which an axially extending groove is formed in and extends along an inner surface of each of the female receptors providing a snap-fit engagement with the flexible ridge where said male cuff is releasably secured in the female receptor.

4. The central vacuum cleaning system defined in claim 3 wherein each of the slots formed in the female receptor is L-shaped.

5. The central vacuum cleaning system defined in claim 1 wherein each of the female receptors include a cylindrical collar in which one of the slots is formed and an annular shoulder formed between said collar and a reduced diameter cylindrical section which terminates in an open end for receiving an end of a conduit of the vacuum cleaning system.

6. The central vacuum cleaning system defined in claim 1 wherein a pair of lugs extend diametrically outwardly from each of the male cuffs and are releasably received within a pair of slots formed in the female receptor.

7. The central vacuum cleaning system defined in claim 1, wherein each of the end connections is a bayonet-type connector and including a sealing O-ring between the male cuff and female receptor.

8. The central vacuum cleaning system defined in claim 1, further comprising ridges on one of the male cuffs that snap into complementary-shaped axially extending grooves formed in one of the female receptor, wherein as the male cuff and female receptor are rotated with respect to each other, the ridges snap into the grooves and provide an audible sound or indication that is adapted to provide an audible indicator to inform an installer that a proper connection has been made between the male cuff and female receptor.

9. The central vacuum cleaning system defined in claim 1, wherein each of the female receptors include a cylindrical collar in which one of the slots is formed; and in which an annular shoulder is formed between said cylindrical collar and a reduced diameter cylindrical section which terminates in an open end for receiving an end of a conduit of the vacuum cleaning system.

10. The central vacuum cleaning system defined in claim 9 in which a pair of locking lugs extend diametrically outwardly from each of the male members and are releasably received within a pair of slots formed in each of the female receptors.

11. A method of installing a floor level debris pickup device of a central vacuum cleaning system in a first opening formed in a structure comprising the steps of:

providing a connection assembly including a section of a flexible expandable hose and first and second end connectors mounted on respective open ends of the hose;

extending a rigid section of a tubular conduit pneumatically connected to a vacuum producing unit through a second opening formed in the structure;

connecting the first end connector of the connection assembly to an end of the tubular conduit;

grasping and pulling outwardly on the hose expanding the hose beyond the first opening of the structure for ease of accessibility;

connecting the second end connector of the connector assembly to the pickup device;

moving the pickup device into said first opening formed in the structure by collapsing the expanded hose into an area between said two openings; and securing the pickup device in said first opening of said structure.

12. The method defined in claim 11 including the steps of providing each of the end connectors with a male component and a female component; sliding the male component into the female component and then rotating the male component until an audible sound is produced indicating that the two components are secured together.

13. The method defined in claim 11 including the step of securing the pickup device in the first opening by securing fasteners from the pickup device into the structure.

14. The method defined in claim 13 including the steps of forming the first opening in a kickwall of a cabinet; and connecting the first end connector of the connection assembly to the tubular conduit behind the kickwall of the cabinet and beneath a bottom wall of said cabinet.

15. The method defined in claim 14 including the steps of pulling the male cuff beyond an edge of the cabinet to connect the male cuff to the female receptor which had been previously attached to an outwardly projecting cylindrical collar at a rear opening of the pickup device by the axial rotational snap-fit engagement between the male cuff and female receptor.

16. The method defined in claim 15 including the steps of inserting a cylindrical open end of the female receptor, and securing the cylindrical open end to the female receptor with an adhesive.

17. The method defined in claim 16, wherein after securing the cylindrical open end connection, includes the steps of placing the pickup device within a complementary-shaped aperture by movement in an axial direction of the hose.

18. The method defined in claim 11 including the steps of extending wires from the pickup device to the vacuum producing unit through the second opening.

19. A connection assembly for pneumatically connecting an end of a rigid conduit of a vacuum cleaning system to a debris pickup device comprising:

a length of an expandable hose terminating in a pair of open ends and a pair of end connectors mounted on said open ends of the expandable hose, each of said end connectors having a cylindrical male cuff connected to a respective open end of the hose and a female receptor, one of said female receptors being adapted to be connected to the rigid conduit and the other of said female receptors being adapted to be connected to the debris pickup device;

a lug extending outwardly from the male cuff of each end connector releasably secured with a slot formed in each of the female receptors for releasably connecting said male cuffs within said female receptor; and ridges on one of the male cuffs that snap into complementary-shaped axially extending grooves formed in one of the female receptor, wherein as the male cuff and female receptor are rotated with respect to each other, the ridges snap into the grooves and provide an audible sound or indication that is adapted to provide an audible indicator to inform an installer that a proper connection has been made between the male cuff and female receptor.

20. A connection assembly for pneumatically connecting an end of a rigid conduit of a vacuum cleaning system to a debris pickup device comprising:

a length of an expandable hose terminating in a pair of open ends and a pair of end connectors mounted on said open ends of the expandable hose, each of said end connectors having a cylindrical male cuff connected to a respective open end of the hose and a female receptor, one of said female receptors being adapted to be connected to the rigid conduit and the other of said female receptors being adapted to be connected to the debris pickup device;

a lug extending outwardly from the male cuff of each end connector releasably secured with a slot formed in each of the female receptors for releasably connecting said male cuffs within said female receptor; and wherein each of the female receptors include a cylindrical collar in which one of the slots is formed; and in which an annular shoulder is formed between said cylindrical collar and a reduced diameter cylindrical section which terminates in an open end for receiving an end of a conduit of the vacuum cleaning system.

21. The central vacuum cleaning system defined in claim 20 in which a pair of locking lugs extend diametrically outwardly from each of the male members and are releasably received within a pair of slots formed in each of the female receptors.

* * * * *